US006769738B1

(12) United States Patent
Rivera, Jr. et al.

(10) Patent No.: US 6,769,738 B1
(45) Date of Patent: Aug. 3, 2004

(54) ANCHORED, RELEASABLY TILTABLE ROW OF SEATS

(76) Inventors: Pedro J. Rivera, Jr., 142 Woodworth Ave. Apt. 3V, Yonkers, NY (US) 10701; John P. Tokar, 1055 Mile Square Rd. Apt. 2, Yonkers, NY (US) 10704

( * ) Notice: Subject to any disclaimer, the term of this patent is extended or adjusted under 35 U.S.C. 154(b) by 0 days.

(21) Appl. No.: 10/701,657

(22) Filed: Nov. 6, 2003

(51) Int. Cl.[7] ..... A47C 15/00
(52) U.S. Cl. ..... 297/232; 297/248; 70/261
(58) Field of Search ..... 297/232, 248, 297/335; 52/8, 9, 10; 70/261; 248/188, 501

(56) References Cited

U.S. PATENT DOCUMENTS

| | | | | |
|---|---|---|---|---|
| 2,409,805 A | | 10/1946 | Shikles | |
| D180,188 S | | 4/1957 | Herider | |
| D213,773 S | | 4/1969 | Beardmore | |
| 4,155,202 A | * | 5/1979 | Hartman | 52/9 |
| 4,211,450 A | * | 7/1980 | Sutter | 297/232 |
| 4,275,714 A | | 6/1981 | Lewis | |
| 4,294,048 A | * | 10/1981 | Sutter | 52/9 |
| 5,678,889 A | * | 10/1997 | Purcell, Jr. | 297/257 |
| 5,810,290 A | | 9/1998 | Merensky et al. | |
| 6,053,576 A | | 4/2000 | Jessee | |
| D439,428 S | | 3/2001 | Mizuno | |
| 6,651,469 B2 | * | 11/2003 | Arias | 70/261 |

* cited by examiner

*Primary Examiner*—Peter M. Cuomo
*Assistant Examiner*—Stephen Vu
(74) *Attorney, Agent, or Firm*—Donald R. Schoonover

(57) ABSTRACT

Seat units in a row of seat units are each connected to an operating bar that is rotationally mounted on a support surface. Rotation of the operating bar causes the seat units of the row of seat units to move from a use orientation, wherein the seat elements thereof are oriented essentially parallel to the support surface, to a cleaning orientation, wherein the seat elements of the seat units are oriented at an oblique angle to the support surface whereby the seat units are moved to an orientation in which cleaning beneath the seat units can be effected.

4 Claims, 1 Drawing Sheet

5

ANCHORED, RELEASABLY TILTABLE ROW OF SEATS

BACKGROUND OF THE INVENTION

1. Field of the Invention

The present invention relates to the general art of furniture, and to the particular field of movable and collapsible furniture.

2. Discussion of the Related Art

Attending sporting events, as well as attending concerts, theater, and the like, are extremely popular forms of entertainment. In all of these situations, people are seated for at least part of the performance. Therefore, the design of seats used at such events have received attention in the furniture art. There have been several innovations in this art in recent times. For example, stadium seating has been used in theaters and the like.

However, while there have been advances in several areas of such seating, there has been one area that seems to have been overlooked and is in need of improvement. That area involves the cleaning of a stadium or a theater after the people leave. People often eat at their seats before, during, and after an event. In fact, such action is often greatly encouraged by most event promoters. While food consumption may have many advantages, the debris left behind is a disadvantage. Clean-up crews often spend many hours cleaning a stadium or a theater after an event. This is a costly and time-consuming operation and may affect the scheduling of later events at the same venue. Therefore, anything that will improve the efficiency of a clean-up operation may have significant advantages.

Cleaning around and under seats is especially difficult and time-consuming. Workers often must actually get down on their hands and knees to be sure that areas under all seats are completely clean. This difficulty is exacerbated when there is a long row of seat. Gaining access to the areas beneath seats in a long row of seats can be very difficult and awkward.

Therefore, there is a need for a means to make cleaning under seats in a row of seats easy and expeditious.

PRINCIPAL OBJECTS OF THE INVENTION

It is a main object of the present invention to provide furniture that is easily manipulated for cleaning purposes.

It is another object of the present invention to provide rows of seats that are easily manipulated.

It is another object of the present invention to provide rows of seats that can be easily manipulated from a use orientation to an orientation which provides access to the area under the seats in the row of seats.

SUMMARY OF THE INVENTION

These, and other, objects are achieved by an anchored, releasably tiltable row of seats which comprises a support surface; a row of seat units having a plurality of side-by-side seat units on the support surface; an operating bar fixedly connected to each seat unit of the plurality of seat units, the operating bar having a longitudinal axis and a first end having key-accommodating elements therein; an operating bar support bracket mounted on the support surface, the operating bar being rotationally mounted on the operating bar support bracket to be rotatable about the longitudinal axis of the operating bar; a key element sized and shaped to be accommodated in the key-accommodating elements of the operating bar to rotate the operating bar via the key element. The seats units of the plurality of seat units being movable with the operating bar to move between a first orientation having a seat of each seat unit oriented parallel to the support surface and a second orientation having the seat of each seat unit oriented at an oblique angle to the support surface.

The seat units can thus be oriented in a use orientation for accommodating seating, but can be easily moved into a cleaning orientation in which a great part of each of the seat units is in an orientation that frees the space beneath the seat units for access. Cleaning, or the like, can thus be effected beneath the out-of-the way seat units.

BRIEF DESCRIPTION OF THE DRAWING FIGURES

DETAILED DESCRIPTION OF THE PREFERRED EMBODIMENT

Figure 2:
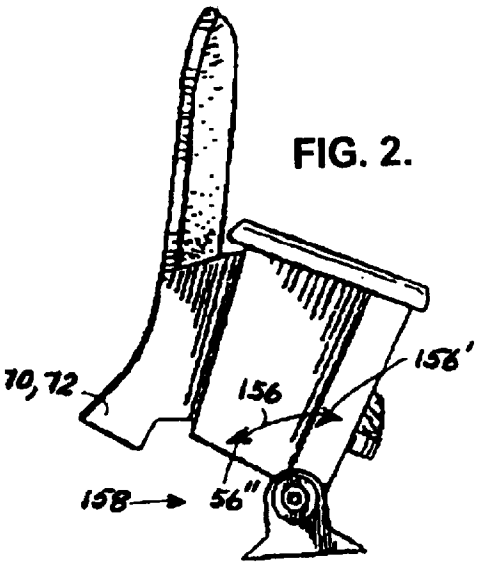
FIG. 2 is a side elevational view of a seat in a tilted orientation in accordance with the teaching of the present invention.
Figure 3:
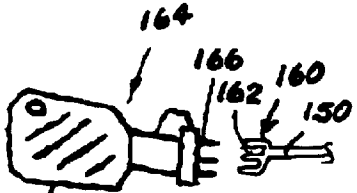
FIG. 3 shows a key used to move the row of seats from the FIG. 1 use orientation to the FIG. 2 tilted orientation.

Other objects, features and advantages of the invention will become apparent from a consideration of the following detailed description and the accompanying drawings.

As shown in the figures, the present invention is embodied in an anchored, releasably tiltable row of seats 10 that can be moved between a use orientation suitable for seating and a cleaning orientation in which the area beneath the present invention 10 is accessible. The anchored, releasably tiltable row of seats 10 comprises a first seat unit 12 which includes a first side 14 having, in a use orientation shown in FIG. 1, a bottom edge 16 of the first side 14, a top edge 18 of the first side 14, a front edge 20 of the first side 14, a rear edge 22 of the first side 14, a transverse axis 24 of the first side 14 extending between the front edge 20 of the first side 14 and the rear edge 22 of the first side 14, a longitudinal axis 26 of the first side 14 extending between the bottom edge 16 of the first side 14 and the top edge 18 of the first side 14, an inside surface 30, and an outside surface 32.

Figure 1:
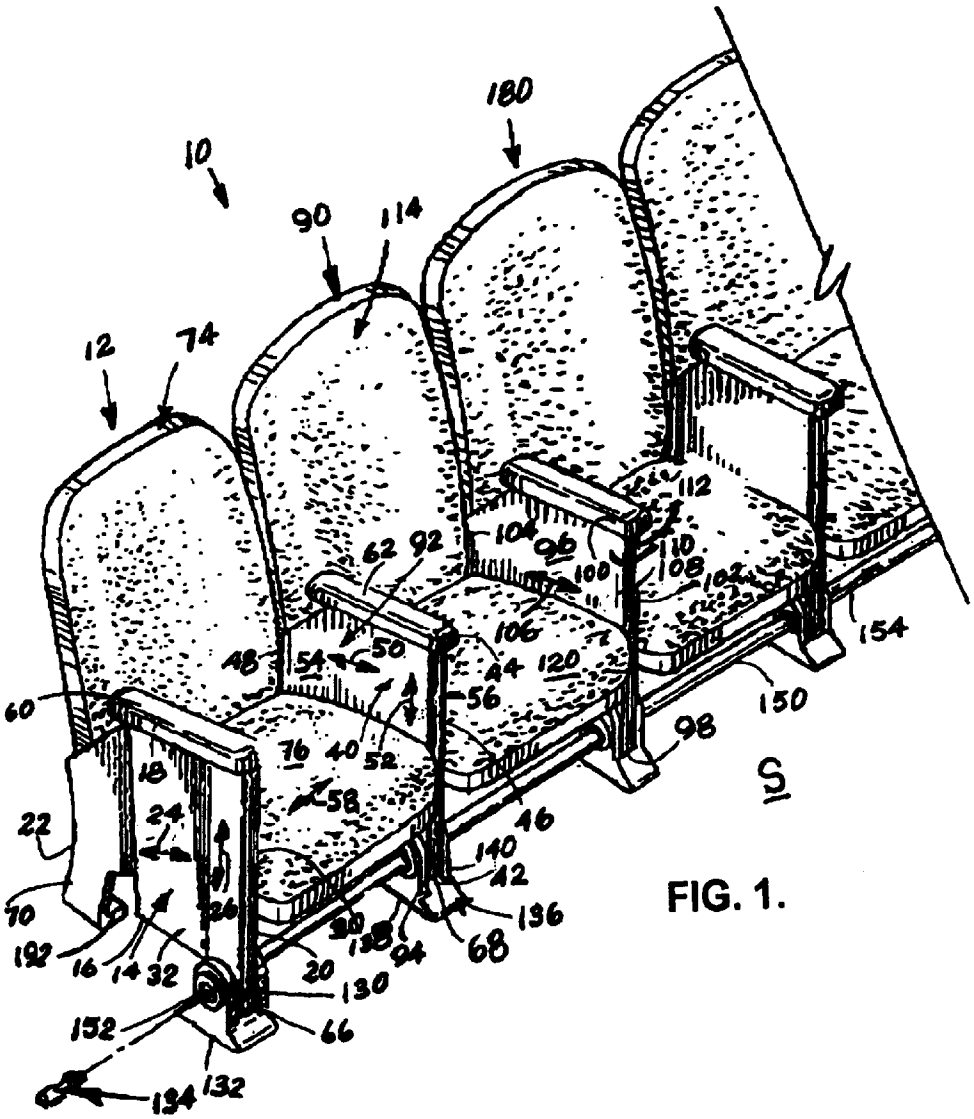
FIG. 1 is a perspective view of a row of seats which are movable in accordance with the teaching of the present invention and which are in a use orientation.

A second side 40 is spaced apart from the first side 14 and has, in the use orientation shown in FIG. 1, a bottom edge 42 of the second side 40, a top edge 44 of the second side 40, a front edge 46 of the second side 40, a rear edge 48 of the second side 40, a transverse axis 50 of the second side 40 extending between the front edge 46 of the second side 40 and the rear edge 48 of the second side 40, and a longitudinal axis 52 of the second side 40 extending between the bottom edge 42 of the second side 40 and the top edge 44 of the second side 40. The second side 40 further includes an inside surface 54 and an outside surface 56. A width direction 58 extends between the first side 14 and the second side 40.

A first arm rest 60 is located on the top edge 18 of the first side 14, and a second arm rest 62 is located on the top edge 44 of the second side 40.

A first front foot 66 is located on the bottom edge 16 of the first side 14 near the front edge 20 of the first side 14 and a second front foot 68 is located on the bottom edge 42 of the second side 40 near the front edge 46 of the second side 40. A first rear foot 70 is located on the bottom edge 16 of the first side 14 near the rear edge 22 of the first side 14, and a second rear foot 72 is located on the bottom edge 42 of the second side 40 near the rear edge 48 of the second side 40. The second rear foot 72 is identical to the first rear foot 70.

A back support element 74 of the first seat unit 12 is fixed to the rear edge 22 of the first side 14 of the first seat unit 12 and to the rear edge 48 of the second side 14 of the first seat unit 12 and extends from the rear edge 22 of the first side 14 of the first seat unit 12 to the rear edge 48 of the second side 40 of the seat unit 12. The back element 74 also extends in the direction of the longitudinal axis 26 of the first side 14 of the first seat unit 12.

A seat element 76 of the first seat unit 12 is fixed to the inside surface 30 of the first side 14 of the first seat unit 12 and to the inside surface 54 of the second side 40 of the seat unit 12 and extends from adjacent to the front edge 20 of the first side 14 of the first seat unit 12 to adjacent to the rear edge 22 of the first side 14 of the first seat unit 12 and adjacent to the back support element 74 of the first seat unit 12. The seat element 76 of the first seat unit 12 is located between the top edge 18 of the first side 14 of the first seat unit 12 and the bottom edge 16 of the first side 14 of the first seat unit 12.

A second seat unit 90 is located adjacent to the first seat unit 12. Additional seat units are also included but will not be discussed as those skilled in the art will understand what elements are included in such additional seat units from the teaching of the present disclosure. The second seat unit shares the second side 40 of the first seat unit 12 as a common side 92 with the outside surface 56 of the second side 40 of the first seat unit 12 being an inside surface of the common side 92 of the second seat unit 90. The second seat unit 90 also shares the second front foot 68 of the first seat unit 12 as a common front foot 94. The second seat unit 90 shares the second rear foot 72 of the first seat unit 12 as a common rear foot.

The second seat unit 90 includes a third side 96 spaced from the second side 40 of the first seat unit 12 in the direction of the width direction 58 of the first seat unit 12. Second unit 90 has, in a use orientation, a bottom edge 98 of the third side, a top edge 100 of the third side 96, a front edge 102 of the third side 96, and a rear edge 104 of the third side 96. A transverse axis 106 of the third side 96 extends between the front edge 102 of the third side 96 and the rear edge 104 of the third side 96, and a longitudinal axis 108 of the third side 96 extends between the bottom edge 98 of the third side 96 and the top edge 100 of the third side 96. An inside surface 110 and an outside surface 112 are also included on third side 96.

A back support element 114 of the second seat unit 90 is fixed to the rear edge 48 of the second side 40 of the first seat unit 12 and to the rear edge 104 of the third side 96 of the second seat unit 90. The back element 114 of the second seat unit 90 also extends in the direction of the longitudinal axis 52 of the second side 40 of the first seat unit 12. The back support element 114 of the second seat unit 90 is substantially co-planar with the back support element 74 of the first seat unit 12.

A seat element 120 of the second seat unit 90 is fixed to the outside surface 56 of the second side 40 of the first seat unit 12 and is also fixed to the inside surface 110 of the third side 96 of the second seat unit 90. Seat element 120 extends from adjacent to the front edge 46 of the second side 40 of the first seat unit 12 and adjacent to the front edge 102 of the third side 96 of the second seat unit 90 to adjacent to the rear edge 48 of the second side 40 of the first seat unit 12 and adjacent to the rear edge 104 of the third side 96 of the second seat unit 90 and adjacent to the back support element 114 of the second seat unit 90. The seat element 120 of the second seat unit 90 is located between the top edge 44 of the second side 40 of the first seat unit 12 and the bottom edge 42 of the second side 40 of the first seat unit 12, and is substantially co-planar with the seat element 76 of the first seat unit 12.

The first seat unit 12 and the second seat unit 90, like all of the other seat units of the present invention 10, are coupled together via the common side 92 and the common front foot 94 and the common rear foot to be a single unit.

First and second seat units 12, 90 rest on a support surface S, such as a floor, or the like.

A first support foot unit 130 is connected to the first front foot 66 of the first seat unit 12 and includes a base surface 132 which rests on support surface S and a body 134 extending upward from the base surface 132 of the first support foot 130 in the use configuration shown in FIG. 1.

A second support foot 136 is connected to the second front foot 68 of the first seat unit 12 and includes a base surface 138 of the second support foot 136 and a body 140. The body 140 of the second support foot 136 extends upward from the base surface 138 of the second support foot 136 in the use configuration shown in FIG. 1. The second seat unit 90 is connected to the second support foot 136.

An operating bar 150 is rotationally supported in the body 134 of the first support foot 130 and is also rotationally supported in the body 140 of the second support foot 136 as well as on further support feet included in the present invention 10. The operating bar 150 extends in the width direction 58 of the first and second seat units 12, 90. The operating bar 150 has a first end 152 located adjacent to the outside surface 32 of the first side 14 of the first seat unit 12 and a longitudinal axis 154 which extends in the width direction 58 of the first and said second seat units 12, 90. The operating bar 150 is rotatable about the longitudinal axis 154 thereof. The first and second sides 14, 40 of the first seat unit 12 and the third side 96 of the second seat unit 90 are fixedly connected to the operating bar 150 for rotational movement therewith.

The first and second seat units 12, 90, as well as additional seat units in the present invention 10, move in the direction indicated in FIG. 2 by arrow 156 as a single unit between a first orientation shown in FIG. 1 with the seat elements thereof oriented horizontally above the support surface S and a second orientation shown in FIG. 2 having the seat units thereof oriented at an oblique angle to the support surface S. In the orientation shown in FIG. 2, the area beneath the seat units, denoted by reference arrow 158, is accessible for cleaning, or the like.

An operating connection 160 on a first end of the operating bar 150 has a plurality of teeth-accommodating holes, such as hole 162, defined therein.

An operating key 164 has teeth, such as tooth 166, sized and shaped to engage the teeth-accommodating holes 162 defined in the operating connection 160 and a handle 168 connected to the teeth 166 of the operating key 164.

As discussed above, the present invention 10 may include a plurality of seat units, including a third seat unit 180, which is identical to the second seat unit 90 and moves with the second seat unit 90 as a unit. Furthermore, a first rear foot support 192 may be located on the first rear foot 70 of the first seat unit 12.

Operation of the present invention 10 can be understood from the foregoing. The row of seats is initially in the use orientation shown in FIG. 1 for accommodating people such as at a sporting event or at a theater. In order to clean the floor after the event, the operating key 164 is inserted into the operating connection 160 on the end of a row of seats and is rotated. Rotation of the operating key 164 allows the row of seats to be tilted from the use orientation shown in FIG. 1 in direction 156' into the FIG. 2 cleaning orientation. Once the floor is cleaned beneath the seat units, the operating key is turned in direction 156" to return the seat units to the FIG. 1 use orientation.

It is to be understood that while certain forms of the present invention have been illustrated and described herein, it is not to be limited to the specific forms or arrangements of parts described and shown.

What is claimed and desired to be covered by Letters Patent is:

1. An article of furniture comprising:

a) a first seat unit which includes (1) a first side having, in a use orientation, a bottom edge of the first side, a top edge of the first side, a front edge of the first side, a rear edge of the first side, a transverse axis of the first side extending between the front edge of the first side and the rear edge of the first side, a longitudinal axis of the first side extending between the bottom edge of the first side and the top edge of the first side, an inside surface and an outside surface, (2) a second side spaced apart from the first side and having, in a use orientation, a bottom edge of the second side, a top edge of the second side, a front edge of the second side, a rear edge of the second side, a transverse axis of the second side extending between the front edge of the second side and the rear edge of the second side, a longitudinal axis of the second side extending between the bottom edge of the second side and the top edge of the second side, an inside surface and an outside surface, (3) a width direction extending between the first side and the second side, (4) a first arm rest on the top edge of the first side, (5) a second arm rest on the top edge of the second side, (6) a first front foot on the bottom edge of the first side near the front edge of the first side, (7) a second front foot on the bottom edge of the second side near the front edge of the second side, (8) a first rear foot on the bottom edge of the first side near the rear edge of the first side, (9) a second rear foot on the bottom edge of the second side near the rear edge of the second side,

(10) a back support element of said first seat unit fixed to the rear edge of the first side of said first seat unit and to the rear edge of the second side of said first seat unit and extending from the rear edge of the first side of said first seat unit to the rear edge of the second side of said seat unit, the back element also extending in the direction of the longitudinal axis of the first side of said first seat unit, and

(11) a seat element of said first seat unit fixed to the inside surface of the first side of said first seat unit and to the inside surface of the second side of said seat unit and which extends from adjacent to the front edge of the first side of said first seat unit to adjacent to the rear edge of the first side of said first seat unit and adjacent to the back support element of said first seat unit, the seat element of said first seat unit being located between the top edge of the first side of said first seat unit and the bottom edge of the first side;

b) a second seat unit located adjacent to said first seat unit, said second seat unit sharing the second side of said first seat unit as a common side with the outside surface of the second side of said first seat unit being an inside surface of the common side of said second seat unit, said second seat unit sharing the second front foot of said first seat unit as a common front foot, said second seat unit sharing the second rear foot of said first seat unit as a common rear foot, said second seat unit including (1) a third side spaced from the second side of said first seat unit in the direction of the width direction of said first seat unit and having, in a use orientation, a bottom edge of the third side, a top edge of the third side, a front edge of the third side, a rear edge of the third side, a transverse axis of the third side extending between the front edge of the third side and the rear edge of the third side, a longitudinal axis of the third side extending between the bottom edge of the third side and the top edge of the third side, an inside surface and an outside surface, (2) a back support element of said second seat unit fixed to the rear edge of the second side of said first seat unit and to the rear edge of the third side of said second seat unit, the back element of said second seat unit also extending in the direction of the longitudinal axis of the second side of said first seat unit, the back support element of said second seat unit being co-planar with the back support element of said first seat unit, and (3) a seat element of said second seat unit fixed to the outside surface of the second side of said first seat unit and fixed to the inside surface of the third side of said second seat unit and which extends from adjacent to the front edge of the second side of said first seat unit and adjacent to the front edge of the third side of said second seat unit to adjacent to the rear edge of the second side of said first seat unit and adjacent to the rear edge of the third side of said second seat unit and adjacent to the back support element of said second seat unit, the seat element of said second seat unit being located between the top edge of the second side of said first seat unit and the bottom edge of the second side of said first seat unit, the seat element of said second seat unit being co-planar with the seat element of said first seat unit;

c) said first seat unit and said second seat unit being coupled together via the common side and the common front foot and the common rear foot to be a single unit;

d) a support surface on which said first and said second seat units rest;

e) a first support foot unit connected to the first front foot of said first seat unit and which includes (1) a base surface, and (2) a body extending upward from the base surface of said first support foot in the use configuration;

f) a second support foot connected to the second front foot of said first seat unit and which includes (1) a base surface of said second support foot, and (2) a body of said second support foot extending upward from the base surface of said second support foot in the use configuration;

g) said second seat unit being connected to said second support foot;

h) an operating bar rotationally supported in the body of said first support foot and rotationally supported in the body of said second support foot and extending in the width direction of said first and second seat units, said operating bar having a first end located adjacent to the outside surface of the first side of said first seat unit and a longitudinal axis extending in the width direction of said first and said second seat units, said operating bar being rotatable about the longitudinal axis of said operating bar;

I) the first and second sides of said first seat unit and the third side of said second seat unit being fixedly connected to said operating bar for rotational movement therewith;

j) said first and second seat units moving as a single unit between a first orientation with the seat elements thereof oriented horizontally above said support surface and a second orientation having the seat units thereof oriented at an oblique angle to said support surface;

k) an operating connection on the first end of said operating bar and having a plurality of teeth-accomodating holes defined therein;

1) an operating key having teeth sized and shaped to engage the teeth-accommodating holes defined in said operating connection and a handle connected to the teeth of said operating key.

2. The article of furniture as described in claim 1 further including a third seat unit which shares the third side of said second seat unit and which is fixedly mounted on said operating bar for movement therewith.

3. The article of furniture as described in claim 2 further including a first rear foot support in the first rear foot of said first seat unit.

4. An article of furniture comprising:

a) a support surface;

b) a row of seat units having a plurality of side-by-side seat units supported on said support surface;

c) an operating bar fixedly connected to each of said seat units of said plurality of seat units, said operating bar having a longitudinal axis and a first end having key-accommodating elements therein;

d) an operating bar support bracket mounted on said support surface, said operating bar being rotationally mounted on said operating bar support bracket to be rotatable about the longitudinal axis of said operating bar;

e) a key element sized and shaped to be accommodated in the key-accommodating elements of said operating bar to rotate said operating bar via said key element; and f) the seats units of said plurality of seat units being movable with said operating bar to move between a first orientation having a seat of each of said seat units oriented parallel to said support surface and a second orientation having the seat of each of said seat units oriented at an oblique angle to said support surface.

* * * * *